US005934231A

United States Patent [19]

Schmitz et al.

[11] Patent Number: 5,934,231

[45] Date of Patent: Aug. 10, 1999

[54] METHOD OF INITIATING MOTION OF A CYLINDER VALVE ACTUATED BY AN ELECTROMAGNETIC ACTUATOR

[75] Inventors: Guenter Schmitz; Franz Pischinger, both of Aachen, Germany

[73] Assignee: FEV Motorentechnik GmbH & Co. KG, Germany

[21] Appl. No.: 09/124,975

[22] Filed: Jul. 30, 1998

[51] Int. Cl.[6] ..... F01L 9/04

[52] U.S. Cl. ..... 123/90.11; 123/90.15

[58] Field of Search ..... 123/90.11, 90.15, 123/198 D

[56] References Cited

U.S. PATENT DOCUMENTS

| | | | |
|---|---|---|---|
| 4,614,170 | 9/1986 | Pischinger et al. | 123/90.11 |
| 5,791,305 | 4/1998 | Kather et al. | 123/90.11 |
| 5,765,514 | 6/1998 | Sono et al. | 123/90.11 |
| 5,797,360 | 8/1998 | Pischinger et al. | 123/90.11 |

*Primary Examiner*—Weilun Lo
*Attorney, Agent, or Firm*—Venable; George H. Spencer; Robert Kinberg

[57] ABSTRACT

A method of initiating motion of at least one of cylinder valve of a cylinder of a reciprocating engine, with each cylinder valve being actuated by an electromagnetic actuator having an electrical closing magnet and an electrical opening magnet, between which magnets an armature that is connected to the cylinder valve to be actuated is movably guided back and forth, counter to the forces of restoring springs, and with the alternating current supply to the closing magnet and the opening magnet being controlled by an electrical engine control. The natural frequency of the spring-mass system formed by the restoring springs and the armature with the cylinder valve is stored in the electrical engine control. The instantaneous rpm and position of the crankshaft with respect to a dead center point position and with reference to the stored natural frequency are detected by the engine control. The time for the beginning of an alternating current supply to the electromagnets is calculated in the period of the natural frequency, taking into consideration the crankshaft rpm and position, the natural frequency of the spring-mass system and the armature path from an inoperative position until it is in contact with the pole surface of one of the two electromagnets, so that the armature motion and the piston motion occur in the same direction immediately before a possible contact of the armature with the pole surface of a capturing magnet.

4 Claims, 2 Drawing Sheets

METHOD OF INITIATING MOTION OF A CYLINDER VALVE ACTUATED BY AN ELECTROMAGNETIC ACTUATOR

CROSS-REFERENCE TO RELATED APPLICATIONS

The right of priority is claimed with respect to German application No. 197 33 142.4 filed in Germany on Jul. 31, 1997, the disclosure of which is incorporated herein by reference.

BACKGROUND OF THE INVENTION

The invention relates to a method of initiating the motion of at least one cylinder valve of a cylinder of a reciprocating engine, with each cylinder valve being actuated by an electromagnetic actuator that has an electrical closing magnet and an electrical opening magnet, between which an armature that is connected to the cylinder valve to be actuated is movably guided back and forth, counter to forces of restoring springs, and with the alternating current supply to the closing magnet and the opening magnet being controlled by an electrical engine control.

In reciprocating engines having cylinder valves that are respectively actuated by electromagnetic actuators, completely-variable valve control is possible. In a multi-cylinder reciprocating engine, such a control permits, for example, the firing of only a portion of the cylinders, during an engine startup process as well as during operation, and the operation of the cylinder valves (preferably in the open position) of the unfired cylinders when the cylinders are shut down. In this case, the other functions, such as fuel injection and ignition of the unfired cylinders, are likewise shut down. Such an operating mode can occur unintentionally, however, when a cylinder valve is not captured by the closing or opening magnet in the provided, respective end position due to external interfering influences, and "hangs" in its central position. This can be determined by a corresponding function monitoring, so fuel injection, ignition and the other cylinder valves of the cylinder can be shut down by the engine control.

SUMMARY OF THE INVENTION

It is an object of the invention to set a shut-down cylinder valve into oscillation in continuous operation, both in a desired, predetermined shutdown of individual cylinders and in a shutdown of a cylinder due to a disturbance in function.

The above and other objects are accomplished according to the invention by the provision of a method of initiating motion of at least one cylinder valve of a cylinder of a reciprocating engine having a crankshaft, with each cylinder valve being actuated by an electromagnetic actuator having an electrical closing magnet and an electrical opening magnet, between which magnets an armature that is connected to the cylinder valve to be actuated is movably guided back and forth, counter to forces of restoring springs, and with an alternating current supply to the closing magnet and the opening magnet being controlled by an electrical engine control, the steps including: storing a natural frequency of the spring-mass system formed by the restoring springs and the armature with the cylinder valve in the electrical engine control; detecting, with the electrical engine control, an instantaneous rpm and position of the crankshaft with respect to a dead center position of the armature and with reference to the stored natural frequency; and calculating the time for the beginning of an alternating current supply to the electromagnets in a period of the natural frequency, taking into consideration the crankshaft rpm and position, the natural frequency of the spring-mass system and the armature path from an inoperative position until the armature is in contact with a pole surface of one of the two electromagnets, so that the armature motion and the piston motion occur in the same direction immediately before a possible contact of the armature with the pole surface of a capturing magnet.

Thus, in accordance with the invention, the natural frequency of the spring-mass system formed by the restoring springs and the armature with the cylinder valve is stored in the electrical engine control. The instantaneous rpm and position of the crankshaft with respect to a dead center position and with reference to the stored natural frequency is detected by the engine control, and a time for the beginning of an alternating current supply to the electromagnets is calculated in the period of the natural frequency, taking into consideration the crankshaft rpm and position, the natural frequency of the spring-mass system and the armature's path from an inoperative position until it is in contact with the pole surface of one of the two electromagnets, and so that armature motion and piston motion occur in the same direction immediately before the possible contact of the armature with the pole surface of a capturing magnet.

An advantage of this method is that the motion of the oscillating valve is supported by the gas flow caused by the back-and-forth motion of the piston, particularly in the motion phase, as soon as the closed position is reached. Hence, the oscillation procedure can be executed with a low energy expenditure with the support of the gas forces.

Because the respective natural frequency of the spring-mass-system formed by the restoring springs on one hand, and the mass represented by the armature and the cylinder valve, on the other hand, and the current engine-operating data are present in the computer of the engine control, an embodiment of the invention provides that the beginning of the current supply to the electromagnetic actuator is established in the period of the natural frequency of the spring-mass system by the electrical engine control so that, shortly before the armature makes contact with the pole surface of the capturing magnet, the armature moves in the direction of the closed position for the relevant cylinder valve as the piston moves upward. Hence, the relatively strong gas forces acting on the relevant cylinder valve are respectively utilized when the closed position is reached.

In an advantageous, further embodiment of the invention, the electromagnets of the electromagnetic actuator are alternatingly supplied with current in the work cycle of the reciprocating engine, and are thus completely re-incorporated into the control process provided for engine operation, after the contact of the armature with one of the pole surfaces is identified by the electrical engine control. At the same time, the injection valve and the ignition are switched on in the provided work cycle, and corresponding to the provided ignition sequence.

In a further embodiment of the method of the invention, it is provided that the beginning of the current supply to the individual electromagnetic actuators of a reciprocating engine is effected successively and respectively following the transition from the oscillation control to the work-cycle control of the preceding electromagnetic actuator. Hence, a perceptible reduction in the energy consumption for the entire system is possible, particularly in reciprocating engines having a plurality of cylinder valves, for example four cylinder valves per cylinder, because a greater energy expenditure is necessary in comparison to the energy expenditure in normal operation, with the associated options of reducing the current consumption for the oscillation process. The load is removed from the on-board network by the method of successive oscillation of the individual cylinder valves.

The method of the invention can be used in its basic form, as well as in the embodiments of the method steps according to the invention, when valve failure occurs during operation, and during the startup procedure of the reciprocating engine, during which the reciprocating engine may not be operated initially with all cylinders, because, in some or all cylinders, the valves have not begun to oscillate at first for purposes of saving energy, and with consideration of the predetermined powers of the on-board network and the generator. Instead, this is postponed until a specific rpm has been attained. In this way, the oscillation process can be executed with a lower energy expenditure with the support of the gas forces.

BRIEF DESCRIPTION OF THE DRAWINGS

The invention is explained in detail in conjunction with schematic drawings.

DETAILED DESCRIPTION OF THE INVENTION

Figure 1:
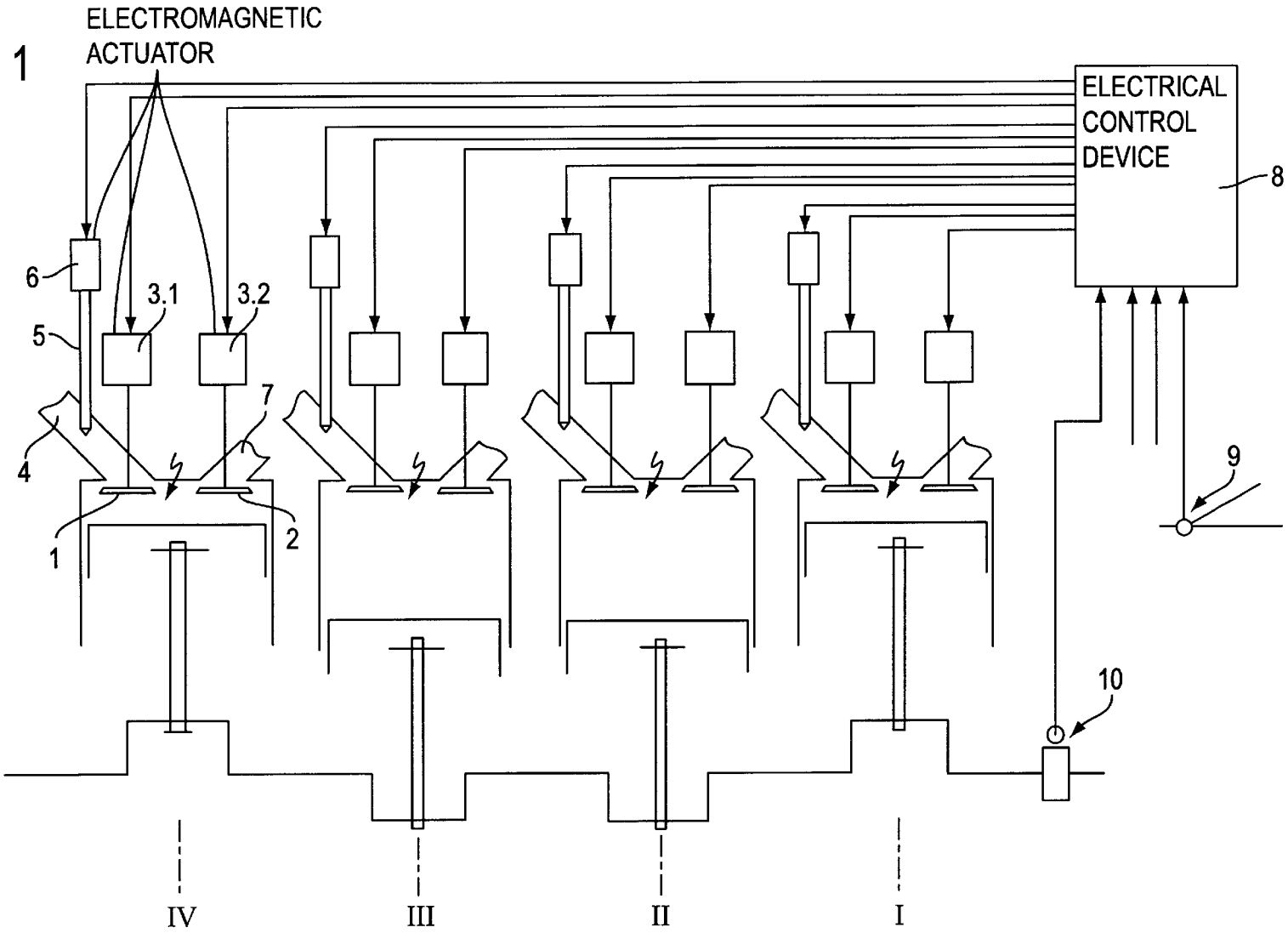
FIG. 1 is a schematic which shows a fundamental illustration of a four-cylinder, four-cycle Otto engine having electromagnetic actuators for the cylinder valves.

FIG. 1 schematically shows a four-cycle, four-cylinder Otto engine having cylinders I, II, III and IV. The individual cylinders each have a gas-intake valve 1 and a gas-outlet valve 2. The two cylinder valves 1, 2 can be actuated by an electromagnetic actuator 3.1 and 3.2, respectively. Gas-intake valve 1 seals a gas-intake conduit 4, into which an injection nozzle 5 terminates. The nozzle can be actuated by an electromagnetic actuator 6. Gas-outlet valve 2 seals a gas-outlet conduit 7.

Electromagnetic actuators 3.1 and 3.2 of the cylinder valves, and electromagnetic actuators 6 of fuel-injection nozzles 5, are triggered by an electrical control device 8, which receives the respective desired load preset, for example via a gas pedal 9. As is standard in modern electronic engine controls, further data necessary for operation are also selected for electrical control device 8, for example, the generated torque, the cooling-water temperature and other values necessary for optimum control and regulation of the course of operation. Moreover, the respective engine rpm is supplied to the control by a corresponding transmitter 10. This rpm transmitter can simultaneously predetermine the crank position and thus the piston position of at least one cylinder, thereby permitting a perfect-fit actuation of the individual electromagnetic actuators that is precise with respect to timing and is rpm-proportional. It is also possible to change the actuation times of the respective gas-intake valves and gas-outlet valves at the individual cylinders, as a function of operation and independently of one another.

Figure 2:
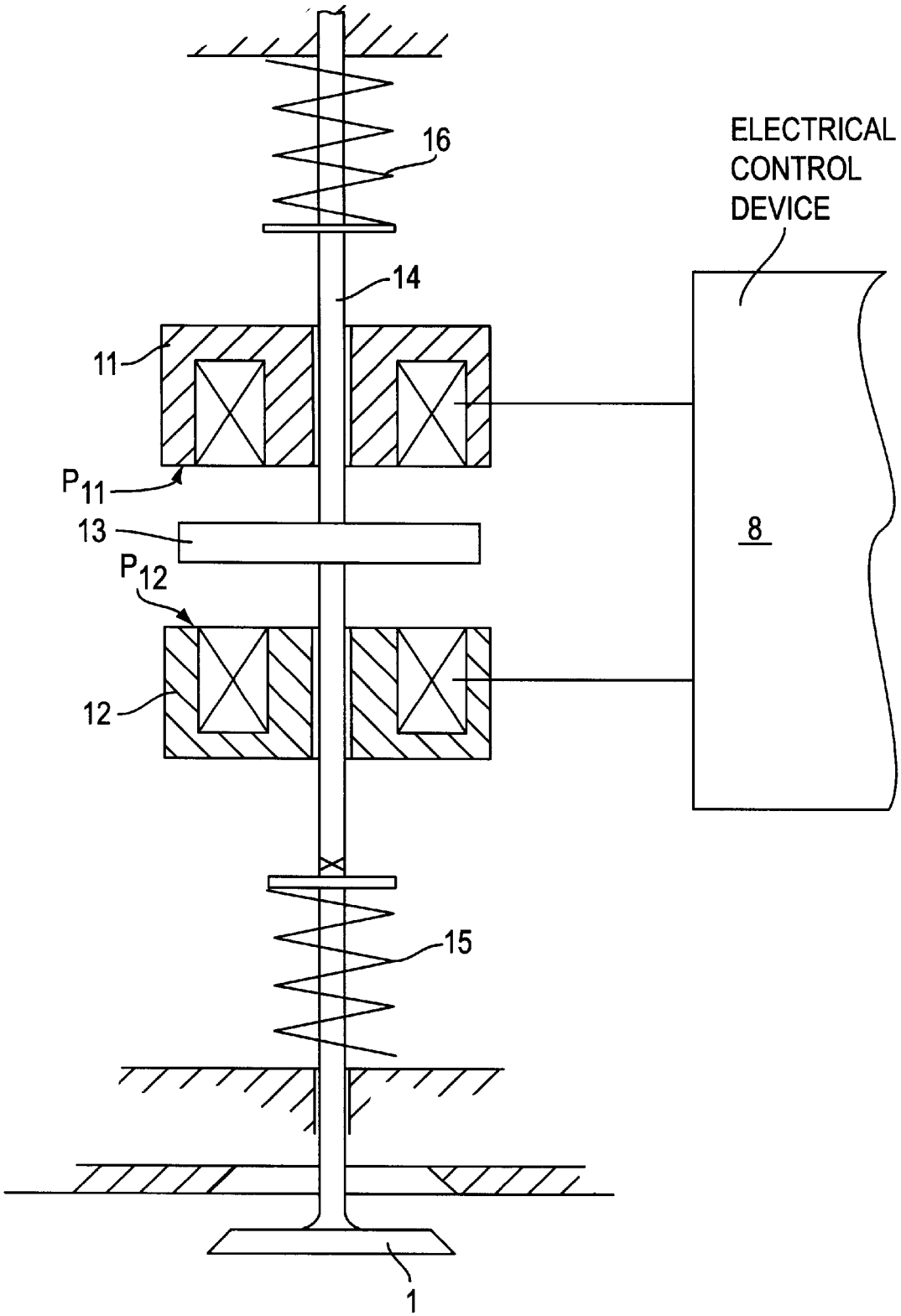
FIG. 2 is a schematic cross section which shows an electromagnetic actuator on an enlarged scale.

As can be seen from FIG. 2, the electromagnetic actuator of a cylinder valve essentially comprises two electromagnets 11 and 12, which are spaced from one another and whose pole surfaces $P_{11}$ and $P_{12}$ are oriented toward one another. An armature 13, which acts on a cylinder valve, for example the gas-intake valve, by an actuation rod 14 is guided to move back and forth between the two electromagnets 11 and 12. The cylinder valve is connected to a closing spring 15, which attempts to draw the cylinder valve into its closed position. Associated with closing spring 15 is an opening spring 16, whose force effect counteracts that of closing spring 15. When no current is supplied to the electromagnet, armature 13 assumes a central position between the two electromagnets. Spring 16 acts as a restoring spring on electromagnet 11 serving as a closing magnet. Likewise, closing spring 15 acts as a restoring spring for electromagnet 12 serving as an opening magnet. Spring 15, 16 and armature 13 together with cylinder valve 1 as a mass forms a spring-mass-system having a natural frequency according to the spring rate of springs 15, 16 and the mass of armature 13 and valve 1. If the two electromagnets are alternatingly supplied with current by electrical control device 8, the cylinder valve can be opened and closed corresponding to the clock that is predetermined by electrical control 8.

Due to an external disturbance, the armature of gas-intake valve 1 at cylinder IV in FIG. 1, for example, may not come into contact with the corresponding pole surface as provided for the relevant motion cycle, but instead may oscillate back into its central position in which case it cannot be started again with the normal "operation control." The shutdown of a valve by means of devices not described in detail here, for example motion sensors associated with the armature, elements of the engine control that register the current and/or voltage course of the actuators, or the like, is determined by the engine control. When a valve is shut down the fuel injection through injection nozzle 5 is immediately inactivated through a control signal, as is the ignition, not shown in detail here, and electromagnetic actuator 3.2 of gas-outlet valve 2 is shut off, so the gas-outlet valve remains in the open position of the central position and, in the course of further engine operation, the failed cylinder can operate, without compression, with the cylinders that continue to function.

Because, as indicated above, all operation-relevant parameters are present in electrical control 8, if a cylinder fails, corresponding processing computers can effect a corresponding change, that is, an increase in the fuel supply to the remaining cylinders, and the necessary changes in the valve control times, thereby increasing the power of the remaining three cylinders such that the power of the failed cylinder 4 is virtually compensated.

Without the aforementioned power increase, that is, immediately after the function at cylinder IV has ceased or following the described power increase in the still-operating cylinders, the "start program" of the engine control initiates the oscillation of the two cylinder valves consecutively, or simultaneously, corresponding to the method described at the outset. As soon as the engine control has again identified problem-free motion of the cylinder valves, fuel injection and ignition are re-actuated, so the relevant cylinder can again contribute its full share of power. A previous increase in the power of the other cylinders is canceled.

The method also proceeds in this manner if the engine control purposefully shuts down individual cylinders, for example for idle operation or low partial-load operation, during which the operating cylinders can operate at full power, or at nearly full power, despite the low powers put out by the engine.

The method of the invention is described above in the context of a reciprocating engine. It is also possible, however, to use this method in the same manner for valve control in a piston compressor whose cylinder valves are not embodied as independent check valves, but are actuated by electromagnetic actuators with the aid of a corresponding valve control.

The invention has been described in detail with respect to preferred embodiments, and it will now be apparent from the foregoing to those skilled in the art, the changes and modifications may be made without departing from the invention in its broader aspects, and the invention, therefore, as defined in the appended claims, is intended to cover all such changes and modifications as to fall within the true spirit of the invention.

What is claimed:

1. A method of initiating motion of at least one cylinder valve of a cylinder of a reciprocating engine having a crankshaft, a piston reciprocating in the cylinder, with each cylinder valve being actuated by an electromagnetic actuator having an electrical closing magnet and an electrical opening magnet, between which magnets an armature that is connected to the cylinder valve to be actuated is movably guided back and forth, counter to forces of restoring springs, and with an alternating current supply to the closing magnet and the opening magnet being controlled by an electrical engine control, the steps comprising:

storing a natural frequency of a spring-mass system formed by the restoring springs and the armature with the cylinder valve in the electrical engine control;

detecting, with the electrical engine control, an instantaneous rpm and position of the crankshaft with respect to a dead center position of the armature and with reference to the stored natural frequency; and calculating the time for the beginning of an alternating current supply to the electromagnets in a period of the natural frequency, taking into consideration the crankshaft rpm and position, the natural frequency of the spring-mass system and the armature path from an inoperative position until the armature is in contact with a pole surface of one of the two electromagnets, so that the armature motion and the piston motion occur in the same direction immediately before a possible contact of the armature with the pole surface of a capturing magnet.

2. The method as defined in claim 1, including establishing the beginning of the current supply to the electromagnetic actuator in the period of the natural frequency of the spring-mass system by the electrical engine control so that, shortly before the armature makes contact with the pole surface of the capturing magnet, the armature moves in a direction of the closed position for the relevant cylinder valve as the piston moves upward.

3. The method as defined in claim 2, including identifying contact of the armature with one of the pole surfaces with the electrical engine control and alternatingly supplying the electromagnets of the electromagnetic actuator with current in a work cycle of the reciprocating engine after the contact is identified in the identifying step.

4. The method as defined in claim 3, including effecting the beginning of the current supply to the individual electromagnetic actuators of the reciprocating engine successively and respectively following a transition from the oscillation control to the work-cycle control of the preceding electromagnetic actuator.

* * * * *